US005941627A

United States Patent [19]

Sacher

[11] Patent Number: 5,941,627

[45] Date of Patent: Aug. 24, 1999

[54] LIGHTING CONDUCTOR RAIL SYSTEM

[76] Inventor: Dominic Sacher, Elsässer Strasse 19, 81667 München, Germany

[21] Appl. No.: 08/831,824

[22] Filed: Apr. 2, 1997

[51] Int. Cl.[6] ..... F21V 21/00; F21S 1/02; H01R 4/60

[52] U.S. Cl. ..... 362/249; 362/250; 362/145; 362/147; 439/208

[58] Field of Search ..... 362/147, 148, 362/226, 249, 391, 396, 407, 145, 250, 806; 439/207, 209, 208, 211, 216, 214

[56] References Cited

U.S. PATENT DOCUMENTS

| | | | |
|---|---|---|---|
| 3,461,220 | 8/1969 | Hukin | 439/209 |
| 3,489,981 | 1/1970 | Corl et al. | 339/21 |
| 3,546,360 | 12/1970 | Bailey | 439/209 |
| 3,718,816 | 2/1973 | Seelbach et al. | 240/52 R |
| 3,748,629 | 7/1973 | Price | 339/21 R |
| 3,821,688 | 6/1974 | Larsile | 439/209 |
| 3,911,637 | 10/1975 | Schmidiger | 439/209 |
| 4,029,378 | 6/1977 | Bolis | 339/22 |
| 4,128,863 | 12/1978 | Premetz | 362/249 |
| 4,414,617 | 11/1983 | Galindo | 362/404 |
| 4,547,030 | 10/1985 | Tanner et al. | 439/209 |
| 4,866,581 | 9/1989 | Targetti | 362/219 |
| 4,888,671 | 12/1989 | Reimer | 362/250 |
| 5,012,395 | 4/1991 | Wettengel et al. | 362/222 |
| 5,045,981 | 9/1991 | Nagano | 362/147 |
| 5,128,847 | 7/1992 | Lin et al. | 362/226 |
| 5,131,860 | 7/1992 | Bogiel | 439/211 |
| 5,154,509 | 10/1992 | Wulfman et al. | 362/226 |
| 5,158,360 | 10/1992 | Banke | 362/391 |
| 5,337,225 | 8/1994 | Brookman | 362/147 |
| 5,353,209 | 10/1994 | Foottit | 362/226 |
| 5,513,081 | 4/1996 | Byers | 362/145 |
| 5,584,576 | 12/1996 | Wei Hong | 362/396 |
| 5,653,412 | 8/1997 | Martorano et al. | 248/222.11 |
| 5,707,136 | 1/1998 | Byers | 362/145 |
| 5,829,865 | 11/1998 | Ahroni | 362/226 |

*Primary Examiner*—Ira S. Lazarus
*Assistant Examiner*—David Lee
*Attorney, Agent, or Firm*—Juettner Pyle Piontek & Underwood

[57] ABSTRACT

The lighting conductor rail system comprises a lighting conductor rail which can be mounted onto a ceiling with the aid of ceiling mounts, as well as luminaire adaptors which are mounted on the lighting conductor rail and which hold each a spotlight, or the like, and electrically connect it to the conductors of the lighting conductor rail. The lighting conductor rail is composed of a carrier profile of a flexible metal which has a flat strip-like shape with a web that projects at a right angle and has a mushroom-shaped snap-in head. Said carrier profile can be assembled under a preload together with a cable profile which consists of a rubber-like material and is shaped like the segment of a circle. The lighting conductor rail can be bent into the desired shape and has a great stability.

16 Claims, 6 Drawing Sheets

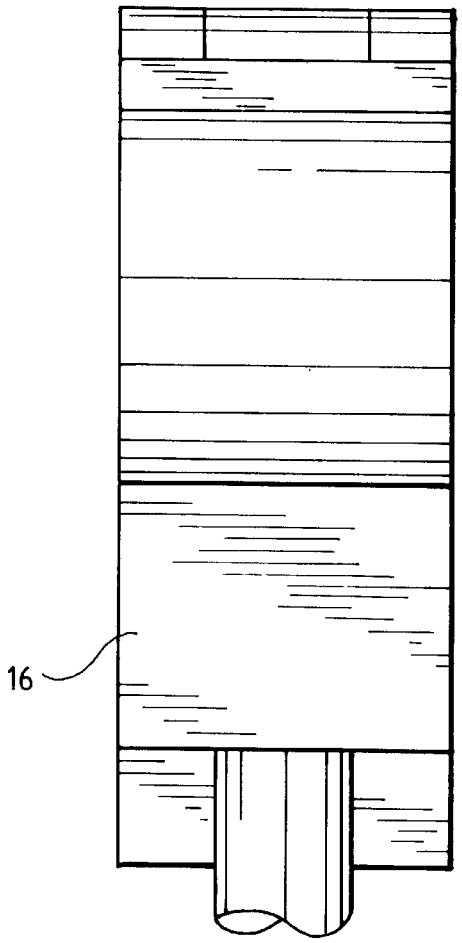
FIG. 4B
FIG. 5
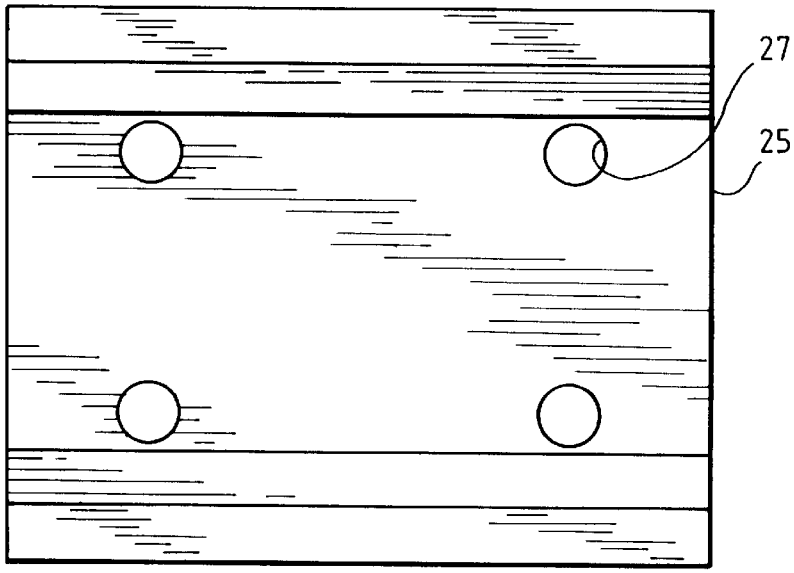
FIG. 5A
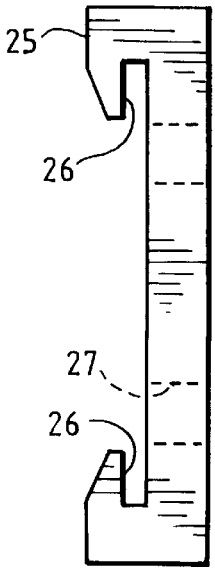

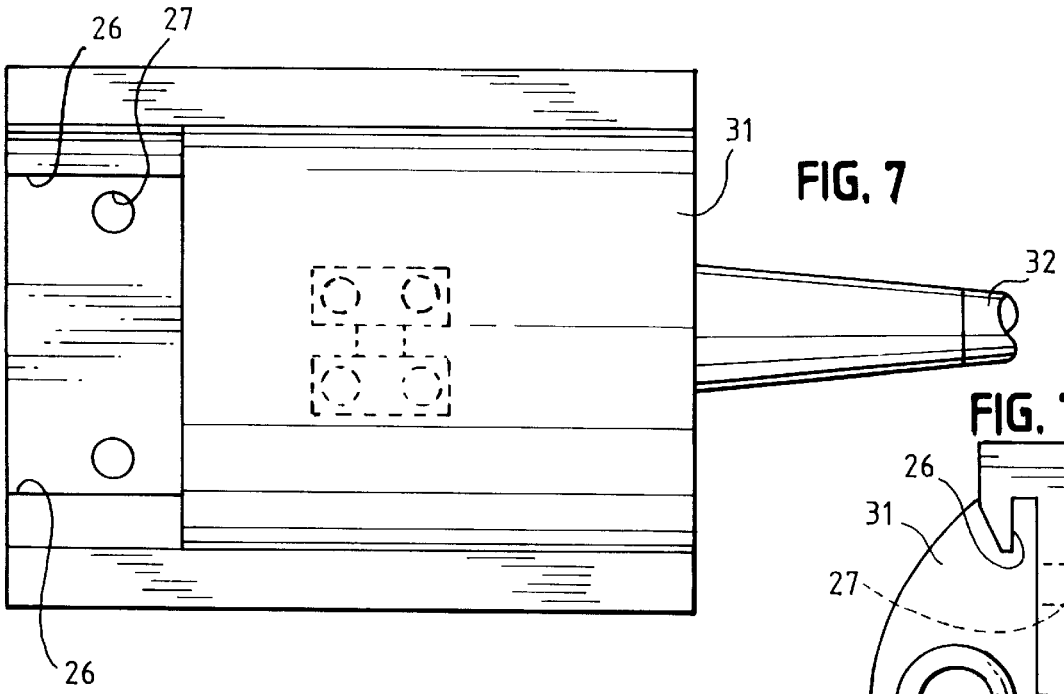
FIG. 7
FIG. 7A
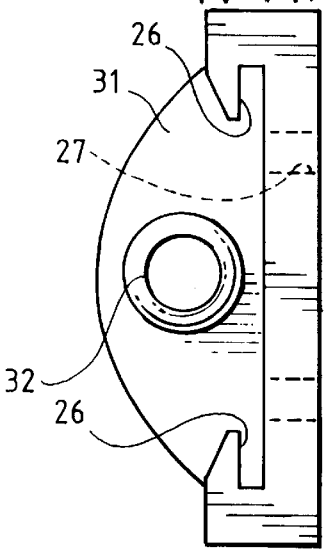
FIG. 8
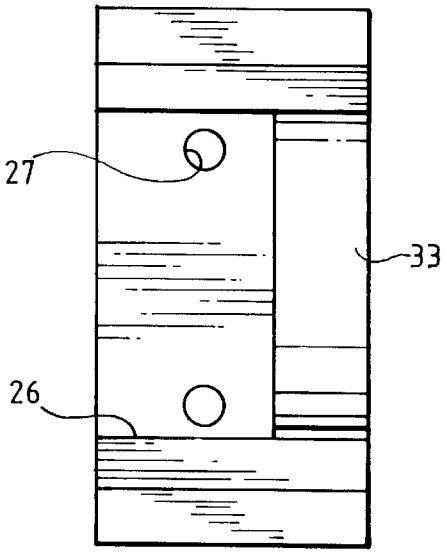
FIG. 8A
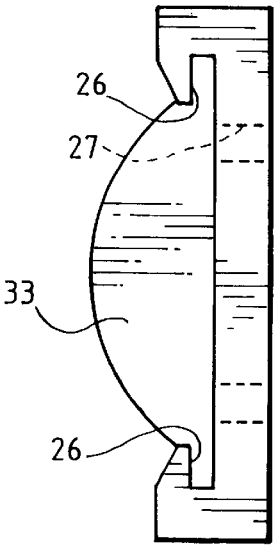

LIGHTING CONDUCTOR RAIL SYSTEM

BACKGROUND OF THE INVENTION

The present invention relates to a lighting conductor rail system comprising a lighting conductor rail and luminaire adaptors which are mountable thereon and hold luminaires, such as halogen spotlights, and which establish an electric contact with the conductors of the lighting conductor rails. As a rule, the lighting conductor rail is mounted on the ceiling of a building, but it can, for instance, also be mounted on a wall.

German patent 195 10 507.9 A1 discloses a lighting conductor rail system whose conductor rail consists of a permanently elastic, electrically non-conducting material into which the electric conductors are embedded such that they are covered by a material jacket. The conductor rail can be bent into any desired shape due to its elastic material. To enable the rail to maintain its shape, a strip-like body of lead or a lead alloy is also embedded into the permanently elastic plastic material. The luminaire adaptors are provided with contact tips which pierce through the material jacket when the luminaire adaptors are being mounted on the conductor rail, thereby establishing an electric contact with the conductors.

This lighting conductor rail system has the disadvantage that it is difficult to embed the lead strip into the plastic material and that the stability imparted by the embedded lead strip to the conductor rail is inadequate. Moreover, it cannot be guaranteed with absolute certainty that when the luminaire adaptors are installed the contact tips will establish a perfect electric contact with the conductors.

It is the object of the present invention to develop a lighting conductor rail system of the known type wherein the conductor rail exhibits increased stability while the advantages of the known system are maintained.

SUMMARY OF THE INVENTION

According to the present invention the lighting conductor rail consists of a carrier profile which gives the lighting conductor rail the necessary strength, and of a cable profile which is detachably secured thereto and preferably consists of a rubber-elastic material and has embedded thereinto at least two, preferably three conductors (phase, protective conductor and neutral conductor).

The carrier profile has a flat strip-like shape and is vertically arranged in its mounted state, i.e. its height is much greater than its width when viewed in cross-section. In a preferred embodiment the small carrier web has a height of about 30 mm and a width of about 1.5 mm.

Furthermore, the carrier profile has a side web which projects from the small carrier web at a right angle and which terminates in a cross-sectionally thickened portion and snaps into a recess of the cable profile. This cross-sectionally thickened portion has preferably the shape of a mushroom. The invention, however, is not confined to such a configuration, but the cross-sectionally thickened portion may, for example, also be shaped like a roof.

The side web, which projects from the carrier web preferably centrally, can also have a flat strip-like shape with a wall thickness which may be slightly smaller than that of the carrier web. The wall thickness may, for instance, be 1 mm.

The carrier profile is preferably deformable along its length. In cases where the carrier profile consists of aluminum or an aluminum alloy, it is, surprisingly enough, plastically deformable about the vertical center axis despite the lateral web with the snap-in head, so that a desired curved course of the lighting conductor rail, which is composed of carrier profile and cable profile, is maintained. On the other hand, the carrier profile has a great flexural strength about the horizontal center axis, so that the lighting conductor rail is very stable on the whole.

The cable profile which preferably consists of an elastomer or of PU/PVC comprises a recess for receiving the side web and the snap-in head of the carrier profile. According to a particularly advantageous suggestion the cable profile is provided at both sides of the recess, which is preferably centrally arranged, with two straight inner surfaces which diverge at a small angle from one another and project more and more towards the edges when the cable profile is not connected to the carrier profile. In the mounted state these inner surfaces rest on the carrier profile under a preload or tension, with the recess being somewhat spread apart so that the inner surfaces are in alignment with one another.

The section of the recess which receives the side web of the carrier profile converges from the contact surface with the carrier profile slightly conically approximately up to web width to press the mushroom-shaped or roof-like snap-in head into the cable profile, whereby the recess is expanded due to the slightly wedge-like shape of the entrance opening. The cross-sectionally thickened portion at the end of the side web will then lock into place behind shoulders of the recess, whereby the cable profile, which rests on the carrier profile under a preload, is connected to the carrier profile in an absolutely reliable manner.

If necessary, this connection can be released without difficulty by bending back the upper and lower sections of the cable profile under expansion of the central recess until the snap-in head is released.

When the side web and the recess are centrally formed on the carrier profile and in the cable profile, respectively, these two structural members will preferably be configured such that they are symmetrical relative to the horizontal center axis.

Furthermore, the cable profile should have a curved outer surface when viewed in cross-section. This may be a circular arcuate shape so that the cable profile is shaped like the segment of a circle in the state in which it is secured to the carrier profile.

The recess should at least extend over half the width of the cable profile, preferably over about 75% of its width. Above and below the recess there is enough room to embed one or two conductors into the cable profile in such a manner that these are covered by at least 1 mm on the outside.

Preferably insulated cable strands are used as conductors. In the mounted position the carrier profile advantageously projects over the cable profile with protruding end sections at the top and at the bottom. The flexural strength of the lighting conductor rail about the horizontal axis is increased owing to the considerable height of the carrier profile, and the end sections of the carrier profile which project at the bottom and at the top can be used in a particularly advantageous manner for securing the luminaire adaptors, ceiling or wall mounts and connectors in an exactly defined position to the lighting conductor rail, which will be described in more detail further below.

The luminaire adaptors which carry a luminaire and establish the electric contact with the conductors of the lighting conductor rail are each provided with a housing including a receiving portion for receiving the lighting conductor rail, which portion comprises a contact surface for the curved outer side of the cable profile and for the end sections of the carrier profile which project at the top and the bottom. This contact surface, which corresponds to the outer contour of the lighting conductor rail, ensures that the lighting conductor rail is exactly positioned in the receiving portion.

Mandrel-shaped contact tips which have a number corresponding to the number of the conductors, and which correspond to the position of the cable strands located in the cable profile, project from the contact surface. Furthermore, the invention suggests that a respective locking member should be hinged to the receiving portion at the top and at the bottom, with the locking members jointly fixing the lighting conductor rail in the luminaire adaptor in the locking position. The locking member which is hinged in the lower portion is here pivoted upwards until it comes to rest on the carrier profile, whereupon the upper locking member is bent downwards, thereby covering the locking member, which is now on the inside, and securing the locking position.

The luminaire adaptor housing is expediently made from glass fiber reinforced plastic, so that it is very stable and will withstand high loads.

The lighting conductor rail is fastened by means of ceiling mounts or wall mounts which, when viewed in cross-section, have an approximately C-shaped holding section with grooves for receiving the end sections of the carrier profile which project at the top and at the bottom. As a result, the lighting conductor rail can be mounted rapidly and easily and is held in an absolutely reliable manner.

Furthermore, the present invention suggests that individual lighting conductor rail pieces should by joinable by connectors which have also an approximately C-shaped holding section, as described above. Threaded holes expediently lead through the wall of the connectors which are passed through by fastening screws, expediently grub screws, with the aid of which the carrier profile is pressed onto the outer groove walls, whereby the connector is fixed in the longitudinal direction onto the two carrier profile pieces. As a consequence, with the aid of said connectors, a lighting conductor rail can be made longer in an easy manner by attaching a further rail piece.

The end of the lighting conductor rail should be secured by an end cap whose cross-sectional shape corresponds approximately to that of the lighting conductor rail, and which is inserted together with the end portion of the lighting conductor rail into a connector as has been described above. The end cap may be slightly overdimensioned in the direction of its width, so that it can be pressed into the grooves of the connector, whereby it is reliably held in the grooves and prevented from falling out of said grooves.

It is also possible to use such a connector in the area of the end feed to connect the embedded conductors of the cable profile to a connection cable. In this case, too, a plastic cover, which corresponds to the outer contours of the lighting conductor rail, can be inserted together with an end section of the lighting conductor rail into the connector, the electric connection being established inside the plastic cover, for instance, via luster terminals Further details of the invention will become apparent from the following description of a preferred embodiment of the lighting conductor rail system of the invention.

BRIEF DESCRIPTION OF THE DRAWINGS

FIG. 5 is a side view and an inner view of a connector for two lighting conductor rail pieces;

FIG. 7 shows an end feed of a lighting conductor rail in a side view and a front view; and FIG. 8 shows the end portion of a lighting conductor rail with an end cap in a side view and a front view.

DESCRIPTION OF THE PREFERRED EMBODIMENTS

Figure 1:
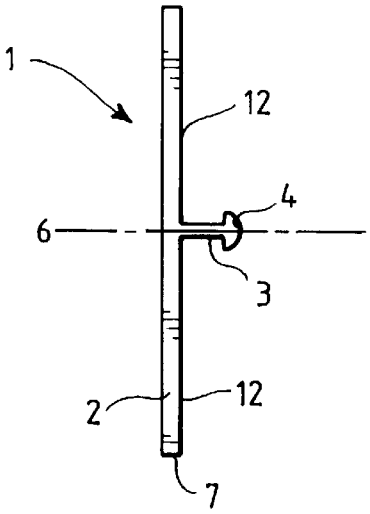
FIG. 1 is a cross-section through a carrier profile of a lighting conductor rail.

FIG. 1 shows a carrier profile 1 in a vertical mounting position. The carrier profile 1 comprises a strip-like, rectangular carrier web 2 which has centrally molded thereon at a right angle a web 3 which is also strip-shaped and terminates in a mushroom-shaped snap-in head 4. Web 3 has a wall thickness which is slightly smaller than that of the carrier web 2. The dimensions of the carrier profile 1 are chosen such that the lighting conductor rail which is composed of the carrier profile 1 and the cable profile 5 (FIG. 2) has a high flexural strength about the horizontal center axis 6, which is the axis of symmetry of the carrier profile at the same time, but, on the other hand, the lighting conductor rail is plastically deformable about the vertical axis 7.

Figure 2:
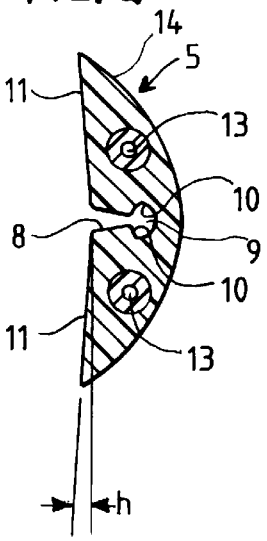
FIG. 2 is a cross-section through a cable profile of a lighting conductor rail.

The cable profile 5, which is shown in cross-section in FIG. 2, has a central recess for receiving the web 3 and the snap-in head 4 of the carrier profile 1, with the recess having a frustroconical section 8 followed by a mushroom-shaped section 9 which substantially corresponds to the outer contours of the snap-in head 4. The recess section 8 widens towards the entrance opening to facilitate the fastening of the cable profile 5 to the carrier profile 1 in that the mushroom-shaped snap-in head 4 resiliently forces apart the side walls which converge in a slightly wedge-shaped configuration. In the mounted position, the mushroom-shaped snap-in head 4 locks into place behind the shoulder 10 of the section 9 of the recess.

In the relaxed state shown in FIG. 2, the contact surfaces of the cable profile 5 converge towards each other at a small angle, i.e. their lateral end sections project by a distance h. In the state in which the snap-in head 4 of the carrier profile engages into the section 9 of the recess of the cable profile, the contact surfaces 11 rest on the contact surfaces 12 of the carrier profile 1 over the whole surface thereof because of the rubber-like material. The carrier profile 1 and the cable profile 5 are firmly connected to a lighting conductor rail in a permanent manner due to this resilient preload.

Above and below the recesses 8, 9, an insulated cable strand 13 is embedded into the cable profile 5, the cable strand 13 being covered at the side of the cross-sectionally circular, arcuate exterior wall 14 by a material layer having a thickness of about 1 mm.

Figure 3:
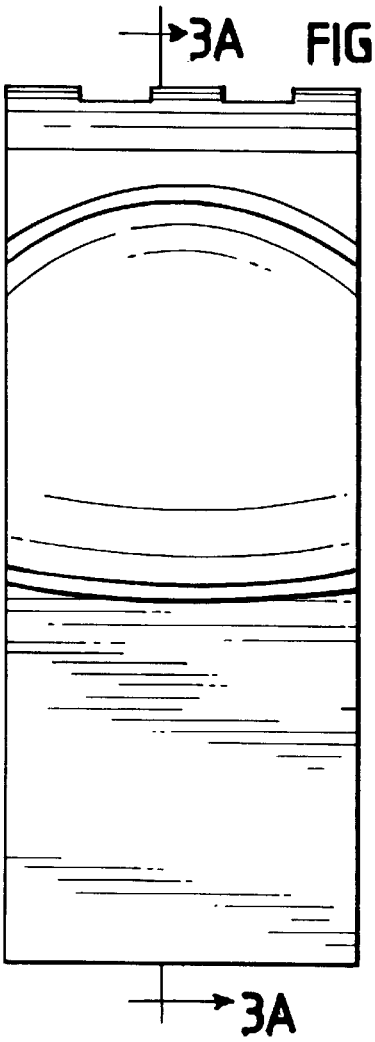
FIG. 3 shows six different views of the receiving portion of a luminaire adaptor.
Figure 3A:
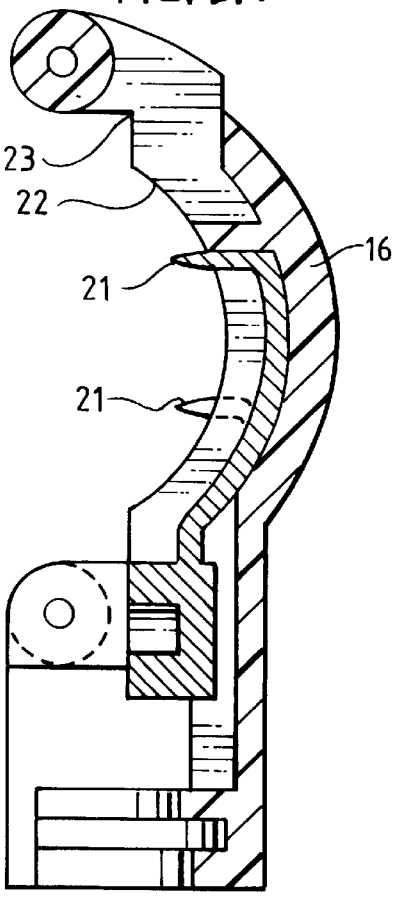
Figure 3B:
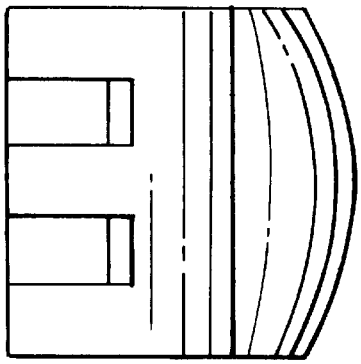
Figure 3C:
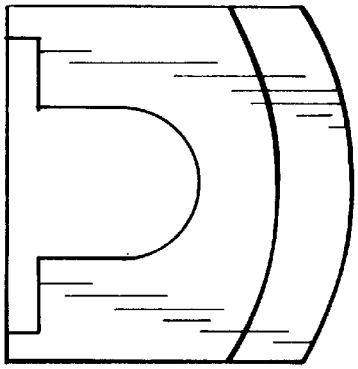
Figure 3D:
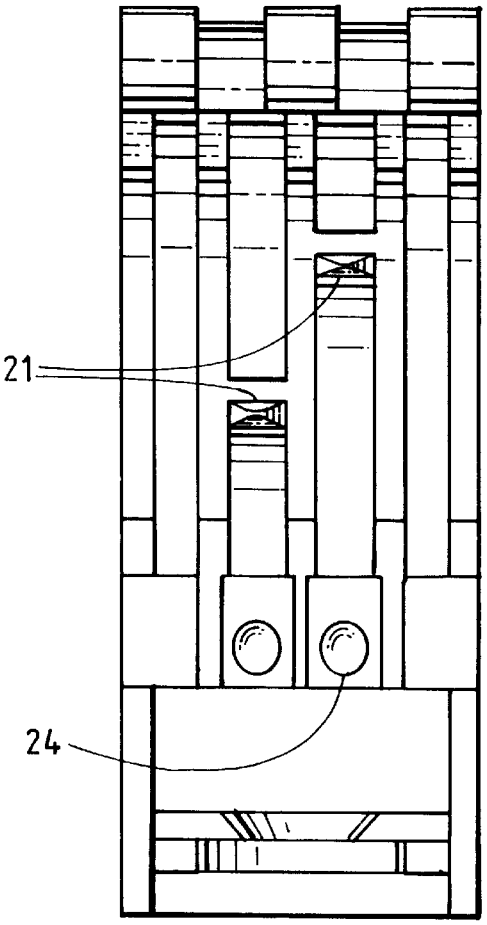
Figure 3E:
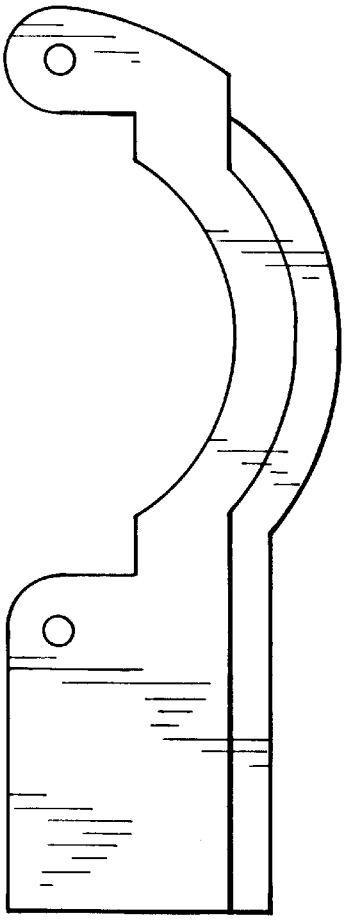
Figure 4:
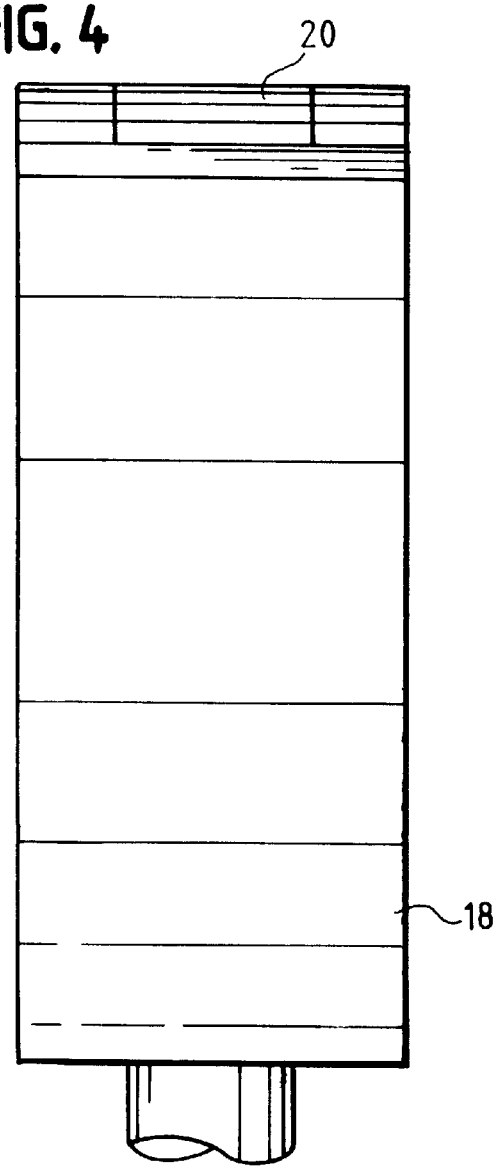
FIG. 4 shows a side view and two front views of a complete luminaire adaptor.
Figure 4A:
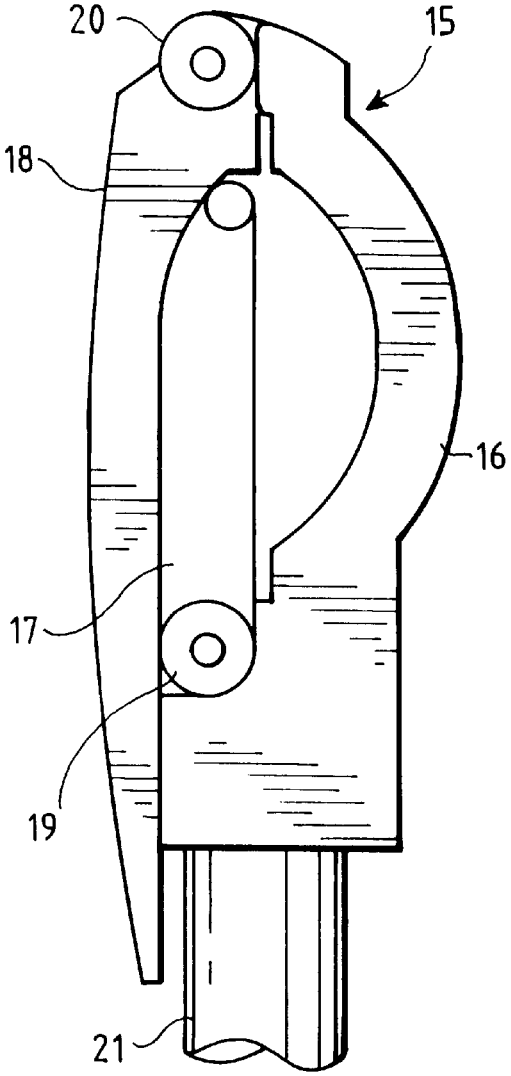

FIGS. 3 and 4 show a luminaire adaptor 15 which is composed of a receiving portion 16, an inner locking portion 17 and an outer locking portion 18. The inner locking portion 17 is connected with a lower joint 19 to the receiving portion 16 while the outer locking portion 18 is hinged to the upper edge of the receiving portion 16 at 20. For instance, a spotlight (not shown) which is brought into electric contact with the conductors 13 in the cable profile 5 via the luminaire adaptor 15 is hung from a cable 21.

For this purpose, as shown in FIG. 3, the receiving portion 16 of the luminaire adaptor 15 is provided with two projecting mandrels which are pressed into the conductors 13 when the luminaire adaptor 15 is mounted on a lighting conductor rail. The receiving portion 16 has a contact surface 22 for the arcuate outer surface 14 of the cable profile 5 and for the end sections of the carrier web 2 of the carrier profile 1 which project beyond the cable profile 5, this contact portion being designated by reference numeral 23 in FIG. 3. The lighting conductor rail is exactly positioned due to this configuration of the receiving portion 16, so that the mandrels 21 are bound to hit upon the conductors 13.

The luminaire adaptor 15 is reliably secured to the lighting conductor rail in that the hinged locking members 17 and 18 are bent in the manner as shown in FIG. 4. The luminaire adaptor 15 is secured in an absolutely reliable manner to the lighting conductor rail in this manner. The electric contact between the mandrels 21 and the conductors which lead to the spotlight is established in terminals 24.

FIG. 5 shows a connector 25 for joining two lighting conductor rail pieces with one another. The connector 25 has an approximately C-shaped profile including grooves 26 for receiving the upper and lower end sections of the carrier web 2. Grub screws can be screwed into threaded holes 27 of the connector 25 to fix the joined end sections of two lighting conductor rails pieces in the connector.

Figure 6:
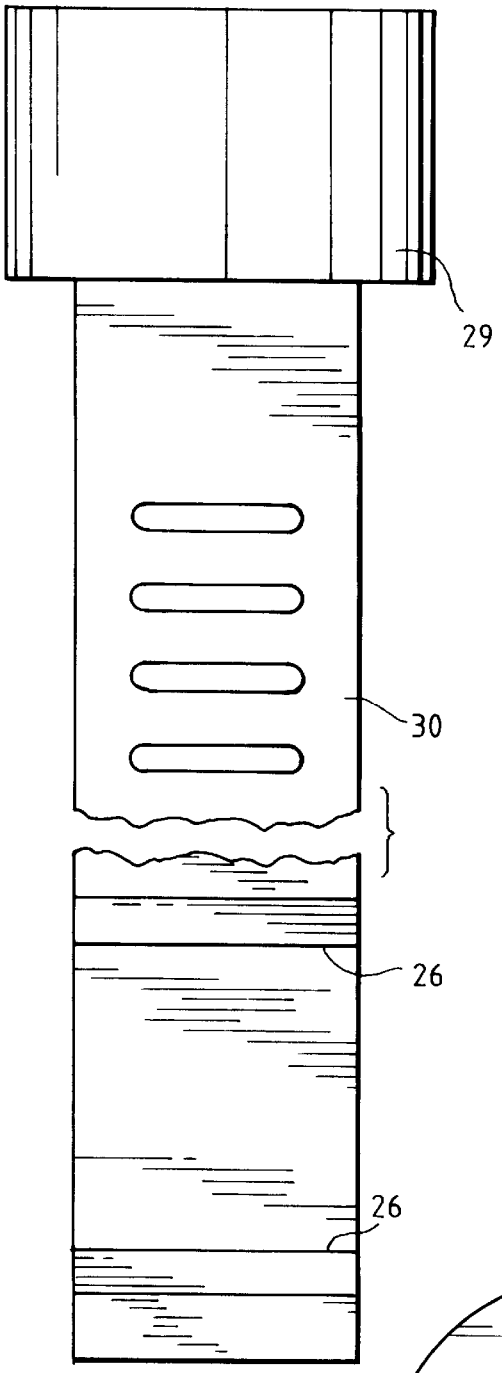
FIG. 6 is a side view, a front view and a top view of a ceiling mount for a lighting conductor rail.
Figure 6A:
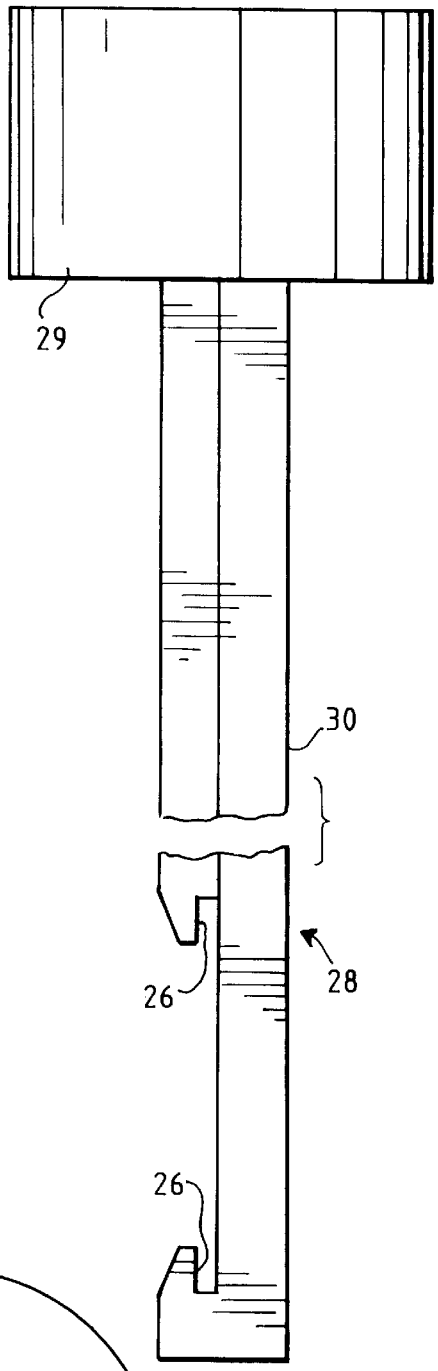
Figure 6B:
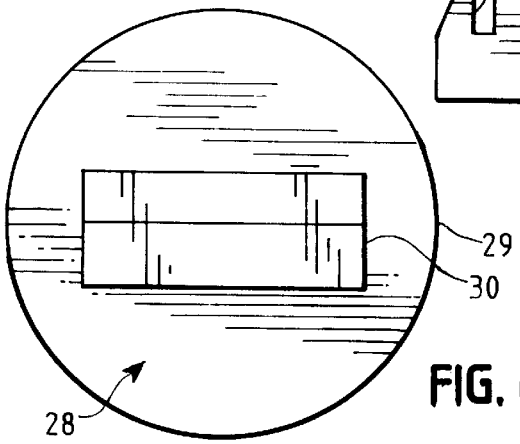

FIG. 6 shows a ceiling mount 28 having a base section 29 to be secured to a ceiling and a web 30 secured therein, which web is provided at the lower end with a receiving section for the lighting conductor rail having the same C-shaped configuration as the connector 25.

As shown in FIGS. 7 and 8, the connectors can be used for the end supply of electric current into the lighting conductor rail and for reliably closing the end of the lighting conductor rail. For the end supply a plastic cover 31 is pressed into the grooves 26 of the connector 25 in contact with the end section of the lighting conductor rail, with the plastic cover 31 having outer contours corresponding approximately to the outer contours of the lighting conductor rail. In the interior of the plastic cover, an electric contact is established between the conductors of a feeder cable 32 and the conductors 13 of the lighting conductor rail.

The end of the lighting conductor rail is secured in that a plastic member 33 is pressed into the connector 25 in contact with the end section of a lighting conductor rail, the plastic member 33, in turn, having outer contours corresponding approximately to those of the lighting conductor rail.

What is claimed is:

1. A lighting conductor rail system comprising a lighting conductor rail forming a carrier profile, a cable profile detachably secured to said rail such that a top and bottom portion of said carrier profile remains exposed, and a luminare adaptor mountable on said rail, said carrier profile having a flat, strip-like shape and comprising a side web projecting at an angle thereto and terminating in a cross-sectionally thickened portion forming a snap-in head, said cable profile comprising an exposed surface on an outer side thereof and a recess for receiving the snap-in head and end of the side web on an inner side in contact with said carrier profile and at least two electrical cable strands contained therein, and said luminaire adapter comprising a housing having a receiving portion with a contact surface corresponding to said outer surface of said cable profile and said exposed top and the bottom portion of said carrier profile and having at least two mandrel-like contact tips projecting from said contact surface of said housing, one each of said at least two contact tips project at points corresponding to a position of one each of said at least two electrical cable strands.

2. The lighting conductor rail system according to claim 1, wherein said carrier profile is vertically arranged in the mounted position.

3. The lighting conductor rail system according to claim 1, wherein said carrier profile can be bent around its cross-sectional longitudinal center axis.

4. The lighting conductor rail system according to claim 1, wherein said carrier profile comprises aluminum.

5. The lighting conductor rail system according to claim 1, wherein prior to installation said cable profile is cross-sectionally provided at both sides of said recess with two straight contact surfaces which converge at an angle towards each other and which in the mounted state rest on said carrier profile with a preload.

6. The lighting conductor rail system according to claim 1, wherein said cable profile has a cross-sectionally curved outer surface.

7. The lighting conductor rail system according to claim 1, wherein said cable profile consists of a rubber-like plastic material.

8. The lighting conductor rail system according to claim 1, wherein each of said at least two electrical cable strands comprise an insulated electrical cable strand embedded into said cable profile, one of said at least two electrical cable strands being above and the other one of said at least two electrical cable strands being below said recess of said inner side of said cable profile.

9. The lighting conductor rail system according to claim 1, wherein said carrier profile projects beyond said cable profile at the top and bottom portion of said carrier profile.

10. The lighting conductor rail system according to claim 1, wherein a respective locking member is hinged to a receiving portion of the luminaire adaptor at the top and at the bottom, with said locking members jointly fixing the lighting conductor rail in said luminaire adaptor.

11. The lighting conductor rail system according to claim 1, wherein the luminaire adaptor housing consists of glass fiber reinforced plastic.

12. The lighting conductor rail system according to claim 1, wherein the carrier profile is adapted to be secured with the aid of either ceiling or wall mounts which are each provided with grooves for receiving the top and bottom portion of the carrier profile projecting upwardly and downwardly from said carrier profile.

13. The lighting conductor rail system according to claim 1, wherein two carrier profile pieces can be joined by connectors which are each provided with groove for receiving the top and bottom portion of the carrier profile projecting upwardly and downwardly from said carrier profile, with threaded holes being guided through the walls of the connectors which are passed through by fastening screws.

14. The lighting conductor rail system according to claim 1 wherein the end of the carrier profile is secured by an end cap whose cross-sectional shape approximately corresponds to that of the combination of the carrier profile and the attached cable profile, and which is pressed into a connector having a groove for receiving the top and bottom portion of the carrier profile projecting upwardly and downwardly from said carrier profile.

15. The lighting conductor rail system of claim 1 wherein the side web projects at a right angle.

16. The lighting conductor rail of claim 1 wherein the cross-sectionally thickened portion has the shape of a mushroom.

* * * * *